US010689885B2

(12) United States Patent
Loudenslager et al.

(10) Patent No.: US 10,689,885 B2
(45) Date of Patent: Jun. 23, 2020

(54) BAR SECURITY SYSTEM

(71) Applicants: Roswitha Loudenslager, Maricopa, CA (US); William Travis Clem, Maricopa, CA (US)

(72) Inventors: Roswitha Loudenslager, Maricopa, CA (US); William Travis Clem, Maricopa, CA (US)

( * ) Notice: Subject to any disclaimer, the term of this patent is extended or adjusted under 35 U.S.C. 154(b) by 50 days.

(21) Appl. No.: 16/150,234

(22) Filed: Oct. 2, 2018

(65) Prior Publication Data

US 2019/0100944 A1 Apr. 4, 2019

Related U.S. Application Data

(60) Provisional application No. 62/566,597, filed on Oct. 2, 2017.

(51) Int. Cl.

| | |
|---|---|
| ***E05B 73/00*** | (2006.01) |
| ***E05C 19/00*** | (2006.01) |
| ***E05B 67/38*** | (2006.01) |
| ***E05C 21/00*** | (2006.01) |
| ***E05B 45/06*** | (2006.01) |

(52) U.S. Cl.

CPC ..... *E05B 73/00* (2013.01); *E05B 45/06* (2013.01); *E05C 19/003* (2013.01); *E05C 21/00* (2013.01); *E05B 67/383* (2013.01)

(58) Field of Classification Search

CPC ..... E05B 73/00; E05B 45/06; E05B 67/38; E05B 67/383; E05C 21/00; E05C 19/003

USPC ..... 70/14, 18, 19, 54–56, 58, 94, 225, 226, 70/461; 292/259 R, 260, DIG. 60, 256, 292/338, 339, 288, 291, 293, 294, 289

See application file for complete search history.

(56) References Cited

U.S. PATENT DOCUMENTS

| | | | | |
|---|---|---|---|---|
| 2,500,375 | A * | 3/1950 | Parker | E05B 73/0076 70/232 |
| 3,399,553 | A * | 9/1968 | Lehto | F17C 13/06 70/158 |
| 3,665,736 | A * | 5/1972 | Wilson | E05B 73/00 70/78 |
| 3,731,504 | A * | 5/1973 | Belknap | E05B 73/0076 70/58 |
| 4,171,079 | A * | 10/1979 | Dietlein | A63C 11/006 280/814 |

(Continued)

FOREIGN PATENT DOCUMENTS

| | | | |
|---|---|---|---|
| EP | 0191743 | * | 8/1986 |

*Primary Examiner* — Lloyd A Gall

(57) ABSTRACT

A bar security system is an apparatus that is used to restrict access to a container. The bar security system includes an upper bracket, a lower bracket, an elongated support structure, a locking mechanism, and a height-adjustment assembly. The upper bracket and the lower bracket are structural elements that define reference points of the bar security system and used to secure the bar security system to a container such as, but not limited to, a storage cabinet. The elongated support structure is used to restrain items that are positioned within the container. The locking mechanism is used to prevent unwanted users from accessing the items positioned within the container. The height-adjustment assembly is used to adjust the bar security system so that the bar security system can be used on a container of any size.

20 Claims, 8 Drawing Sheets

(56) References Cited

U.S. PATENT DOCUMENTS

| | | | | | |
|---|---|---|---|---|---|
| RE30,523 | E * | 2/1981 | Rich | A63C 11/006 | 280/814 |
| 4,899,490 | A * | 2/1990 | Jokel | E06B 9/02 | 49/55 |
| 4,979,769 | A * | 12/1990 | Salyer | E05C 19/004 | 292/338 |
| 5,701,768 | A * | 12/1997 | Khalsa | E05B 13/002 | 70/14 |
| 5,887,464 | A * | 3/1999 | Perez | B60R 25/0225 | 70/209 |
| 6,470,720 | B1 * | 10/2002 | Yang | B60R 25/0225 | 70/209 |
| 6,510,718 | B1 * | 1/2003 | Chang | B60R 25/0225 | 70/209 |
| 6,868,702 | B1 * | 3/2005 | Alkire | E05C 19/003 | 70/14 |
| 7,350,837 | B1 * | 4/2008 | Faires | E05C 19/003 | 292/259 R |
| 8,596,015 | B2 * | 12/2013 | Coon | E05B 73/00 | 248/354.1 |
| 8,864,195 | B2 * | 10/2014 | Sullivan | E05C 17/60 | 292/259 R |

* cited by examiner

BAR SECURITY SYSTEM

The current application claims a priority to the U.S. Provisional Patent application Ser. No. 62/566,597 filed on Oct. 2, 2017.

FIELD OF THE INVENTION

The present invention relates generally to restrictive security systems. More specifically, the present invention is a bar security system that is used to restrict access to the inside of a container.

BACKGROUND OF THE INVENTION

Presently, the convention of securing goods and valuable articles within an extraneous container is either too ill-serving and cheap, or expensive and invasive to the container. There are currently methods which are used to secure items within an extraneous container such as a conventional key lock. However, a conventional key lock can only offer limited security. There presents a need for an intermediate solution that can provide adequate security, but with a modular approach that does not involve destruction or generally alteration of the extraneous container.

It is therefore the objective of the present invention to provide a bar security system that restricts access to a container. The present invention includes multiple security measure such as a locking means, an interface to engage or disengage the locking means, and an alarm system. The locking means can be any type of lock such as, but not limited to, a restraining mechanical lock or restraining magnetic lock. The interface can by any type of lock assembly such as, but not limited to, keypad, a key entry lock, or an electronic code lock. The alarm system is used to alert a user when an unwanted user attempts to breach the locking means. The present invention additionally includes a structural shape which restrains items within a container. With these security measures, the present invention effectively restricts access to an extraneous container compared to conventional methods such as just using a common key lock.

DETAIL DESCRIPTIONS OF THE INVENTION

Figure 1:
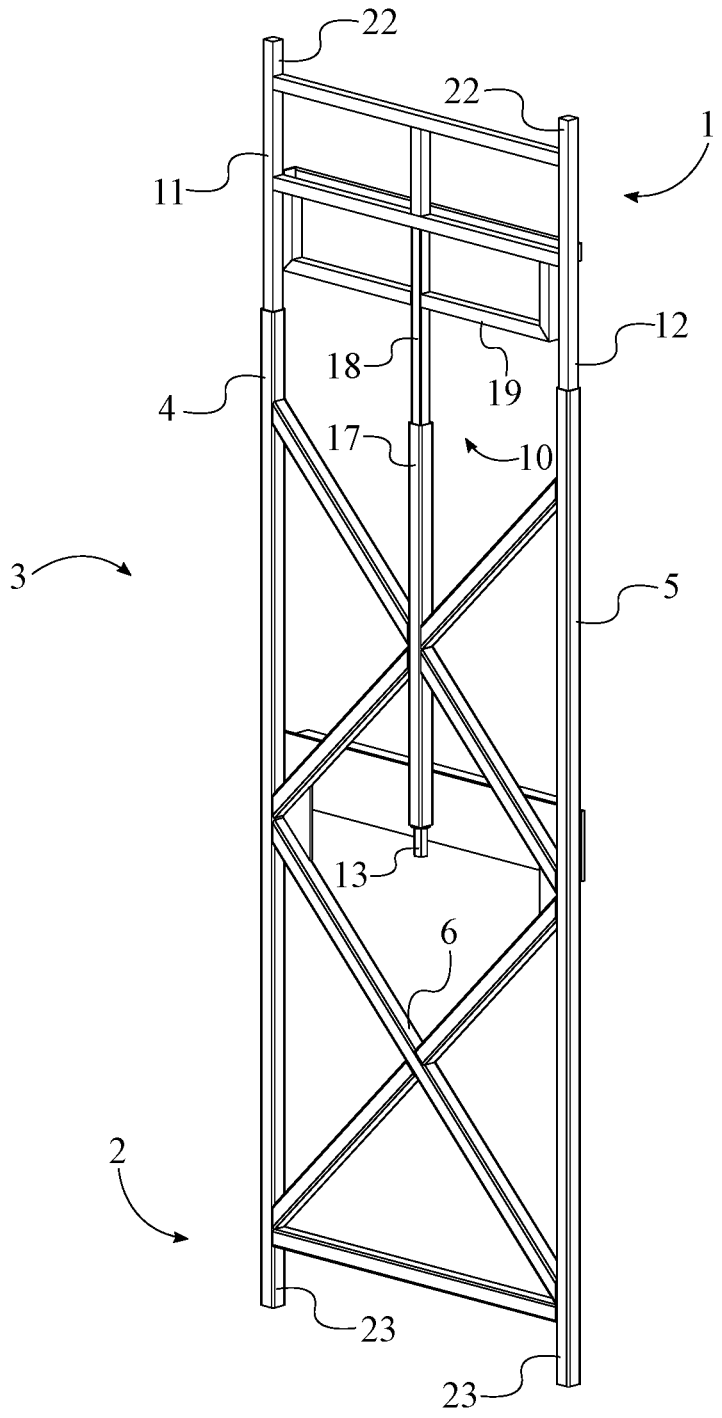
FIG. 1 is a front perspective view of the present invention.

All illustrations of the drawings are for the purpose of describing selected versions of the present invention and are not intended to limit the scope of the present invention.

The present invention is a bar security system that is used to restrict access to a container. The present invention comprises an upper bracket 1, a lower bracket 2, an elongated support structure 3, a locking mechanism 7, and a height-adjustment assembly 10. The upper bracket 1 and the lower bracket 2 are structural elements that define reference points of the present invention and used to secure the present invention to a container such as, but not limited to, a storage cabinet or closet. The elongated support structure 3 is used to restrain items that are positioned within the container. The locking mechanism 7 is used to prevent unwanted users from accessing the items positioned within the container. The height-adjustment assembly 10 is used to adjust the present invention so that the present invention can be used on a container of any size.

The general configuration of the aforementioned components allows the present invention to efficiently restrict access to the inside of a container. In reference to FIGS. 1 and 2, the upper bracket 1 is terminally mounted to the elongated support structure 3, and the lower bracket 2 is terminally mounted to the elongated support structure 3, opposite the upper bracket 1. This arrangement allows the present invention to be properly secured to the inside of a container and allows the present invention to span the entire vertical length of the container. In more detail, the upper bracket 1 can be secured to the inner top surface area of the container, and the lower bracket 2 can be secured to the inner bottom surface area of the container. The locking mechanism 7 is operatively integrated into the elongated support structure 3, wherein the locking mechanism 7 is used to maintain an offset distance between the upper bracket 1 and the lower bracket 2 along the elongated support structure 3. This arrangement allows the present invention to selectively fix the offset distance between the upper bracket 1 and the lower bracket 2. The locking mechanism 7 can be any type of lock such as, but not limited to, a restraining mechanical lock or restraining magnetic lock. With reference to FIG. 3, the upper bracket 1 is operatively coupled to the elongated support structure 3 by the height-adjustment assembly 10, wherein the height-adjustment assembly 10 is used to adjust the offset distance between the upper bracket 1 and the lower bracket 2 along the elongated support structure 3. This arrangement allows the present invention to be properly adjusted to a desired height so that the present invention can be used on a container of any size.

With reference to FIGS. 1 and 3 and in order for the elongated support structure 3 to effectively restrain items positioned within a container, the elongated support structure 3 comprises a first support 4, a second support 5, and at least one truss 6. The first support 4, the second support 5, and the at least one truss 6 are restraining elements that are structurally shaped to prevent items, within a container, from being accessed. The first support 4 and the second support 5 are positioned parallel and offset from each other. This arrangement allows the present invention to properly restrain items of a container. In more detail, the first support 4 is used to restrain items on the inner left side of the container, and the second support 5 is used to restrain items on the inner right side of the container. The at least one truss 6 is connected in between the first support 4 and the second support 5. This arrangement allows the at least one truss 6 to properly the restrain items of a container. In more detail, the at least one truss 6 is used to restrain items of the middle of the container. The height-adjustment assembly 10 is positioned in between the first support 4 and the second support 5 in order to strictly adjust the height of the present invention.

Figure 2:
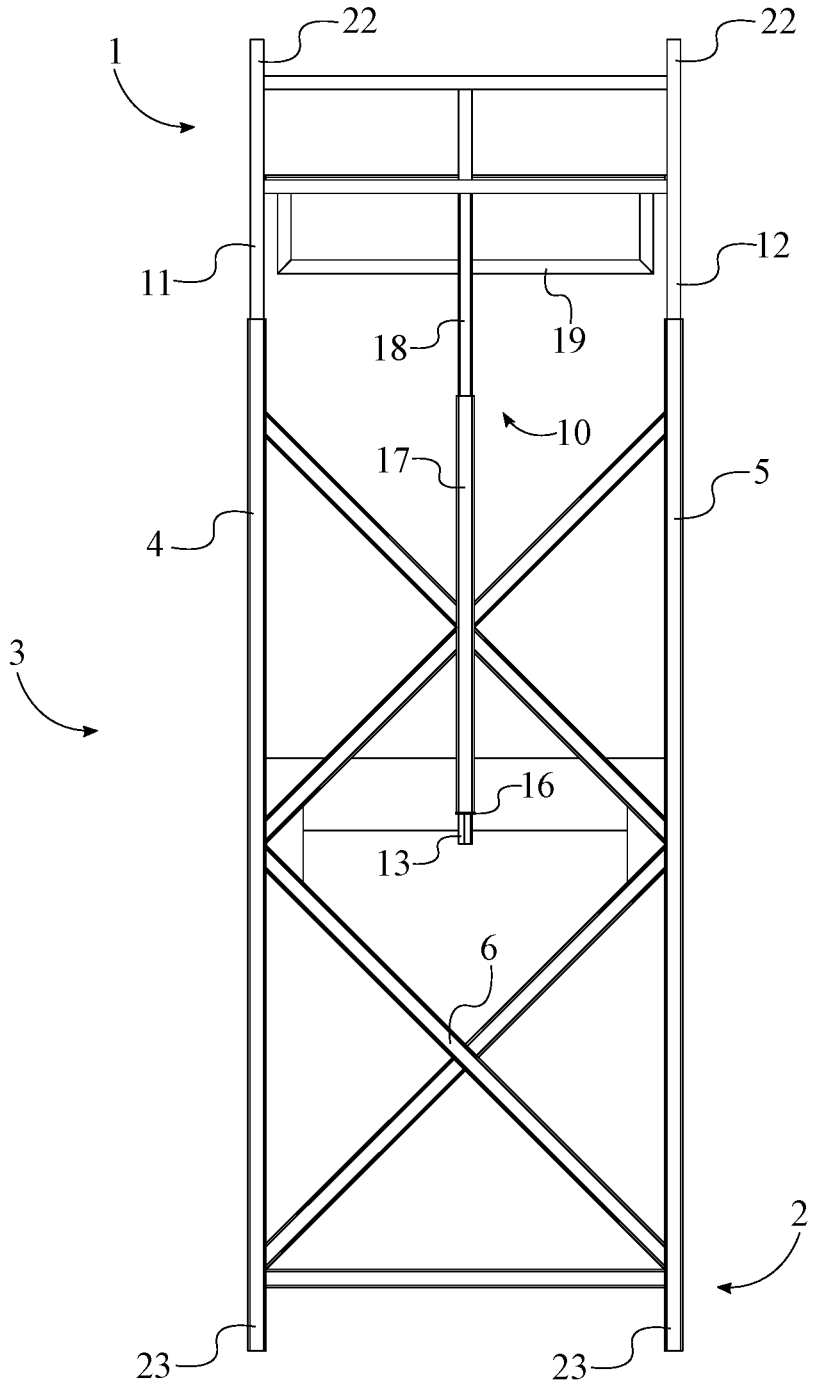
FIG. 2 is a front view of the present invention.
Figure 3:
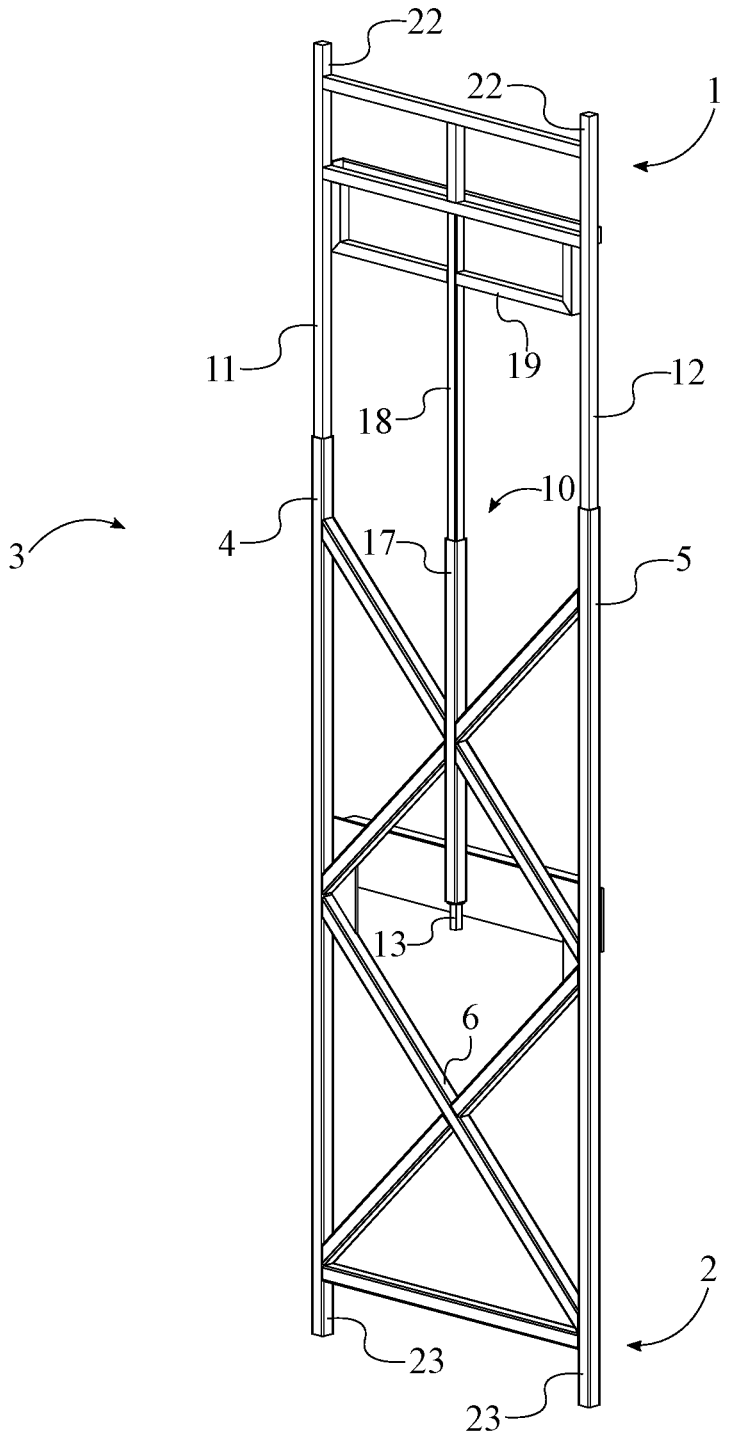
FIG. 3 is a front perspective view of the present invention in an extended state.

With reference to FIG. 2, the height-adjustment assembly 10 comprises a first tube 11 and a second tube 12. The first tube 11 is terminally and perpendicularly connected to the upper bracket 1. This arrangement allows the first tube 11 to provide the necessary upward force that braces the upper bracket 1 against the inner top surface area of a container. The second tube 12 is terminally and perpendicularly connected to the upper bracket 1, opposite the first tube 11. This arrangement allows the second tube 12 to provide the necessary upward force that braces the upper bracket 1 against the inner top surface area of a container. The first tube 11 and the first support 4 are telescopically engaged to each other, while the second tube 12 and the second support 5 are telescopically engaged to each other. This arrangement allows the upper bracket 1 to be moved up and down along the present invention with respect to the first support 4 and the second support 5.

Figure 4:
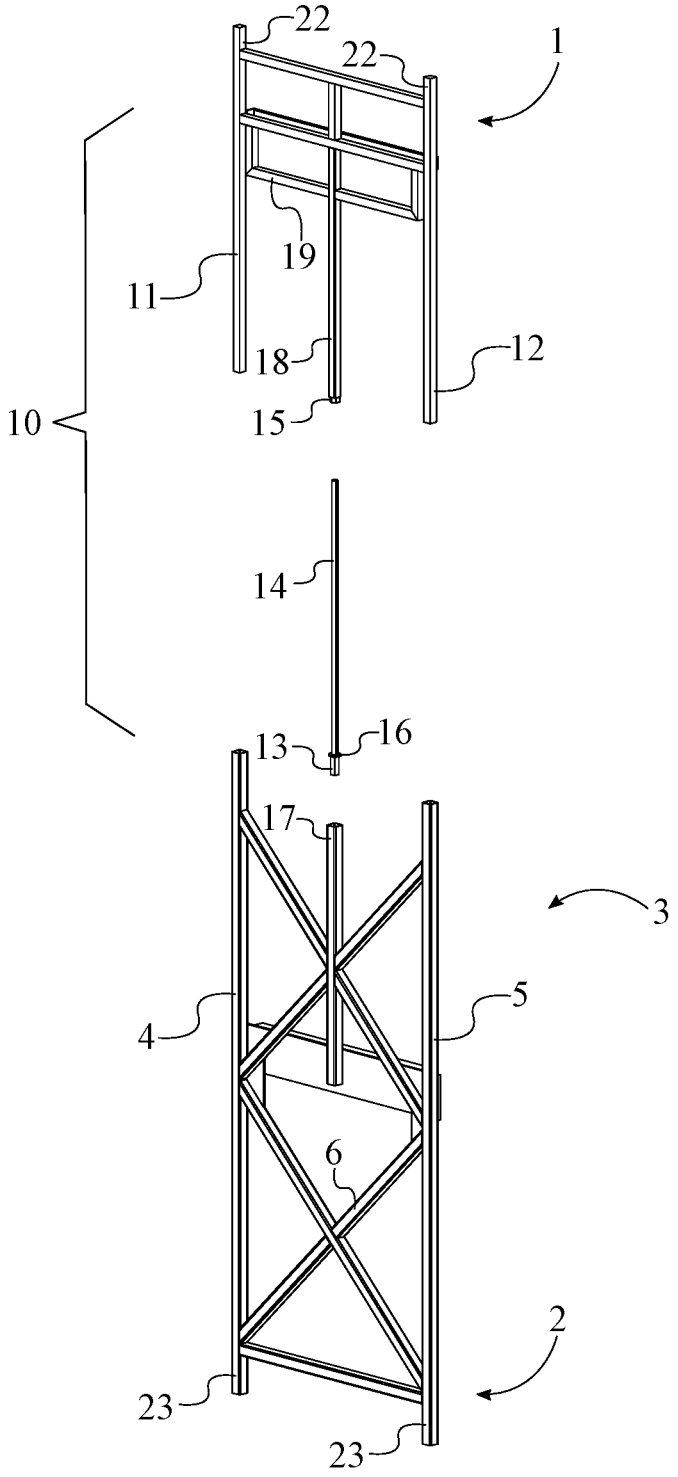
FIG. 4 is an exploded perspective view of the present invention displaying the height-adjustment assembly.

With reference to FIG. 4 and in order to effectively adjust the height of the present invention, the height-adjustment assembly 10 comprises a turn knob 13, a male-threaded shaft 14, a female-threaded nut 15, and stopper 16. The turn knob 13 provides a gripping element that allows the user to screw the male-threaded shaft 14 into the female-threaded nut 15. The male-threaded shaft 14, the female-threaded nut 15, and the stopper 16 are provided as a jack bolt mechanism which allows the height of the present invention to be adjusted. The male-threaded shaft 14 is positioned parallel to the first support 4 and the second support 5, and the male-threaded shaft 14 is rotatably connected to the elongated support structure 3. This arrangement properly positions the male-threaded shaft 14 in order to provide a uniformly distributed upward force when engaged to the female-threaded nut 15. The female-threaded nut 15 is integrated into the upper bracket 1. This arrangement properly positions the female-threaded nut 15 to provide an upward force to the upper bracket 1 therefore moving the upper bracket 1 upwards when the female-threaded nut 15 is engaged by the male-threaded shaft 14. The turn knob 13 is terminally and torsionally connected to the male-threaded shaft 14. This arrangement allows the user to rotate the male-threaded shaft 14 by rotating the turn knob 13. The stopper 16 is laterally connected to the male-threaded shaft 14, adjacent to the turn knob 13. The arrangement allows the stopper 16 to prevent the male-threaded shaft 14 from being over-rotated. The male-threaded shaft 14 is engaged into the female-threaded nut 15, opposite the turn knob 13. This arrangement allows the male-threaded shaft 14 to rotate within the female-threaded nut 15 which causes the upper bracket 1 to be moved either upward or downward depending on the direction of the rotation.

With reference to FIG. 2, the height-adjustment assembly 10 further comprises a third tube 17 and a fourth tube 18. The third tube 17 is used to house the male-threaded shaft 14. The fourth tube 18 is used to hold the female-threaded nut 15. The third tube 17 is centrally connected along the elongated support structure 3. This arrangement properly positions the third tube 17 to house the male-threaded shaft 14. The male-threaded shaft 14 is rotatably mounted within the third tube 17. This arrangement conceals the male-threaded shaft 14 within the third tube 17. The stopper 16 is terminally positioned to the third tube 17. This arrangement prevents the male-threaded shaft 14 from being rotated out of the third tube 17 from where the stopper 16 is positioned. The fourth tube 18 is centrally and perpendicularly connected along the upper bracket 1. This arrangement properly positions the fourth tube 18 to hold the female-threaded nut 15. The female-threaded nut 15 is terminally integrated into the fourth tube 18, opposite the upper bracket 1. This arrangement allows the fourth tube 18 to move with the female-threaded nut 15 when the male-threaded shaft 14 is being screwed through female-threaded nut 15. The third tube 17 and the fourth tube 18 are telescopically engaged to each other so that the movement of the third tube 17 and the fourth tube 18 does not interfere with the linear extension or retraction between the male-threaded shaft 14 and the female-threaded nut 15.

Figure 5:
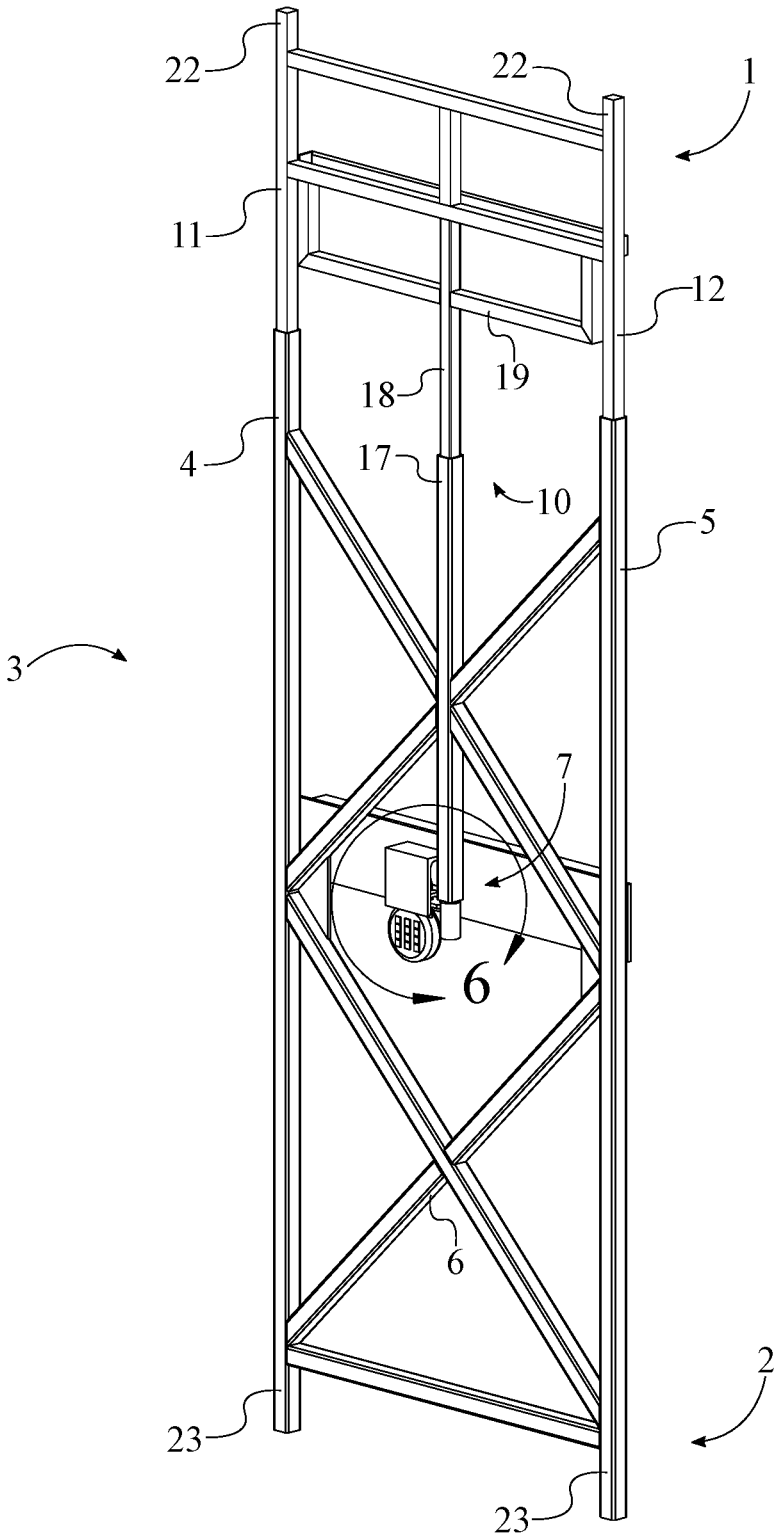
FIG. 5 is a front perspective of the present invention displaying the locking mechanism.
Figure 6A:
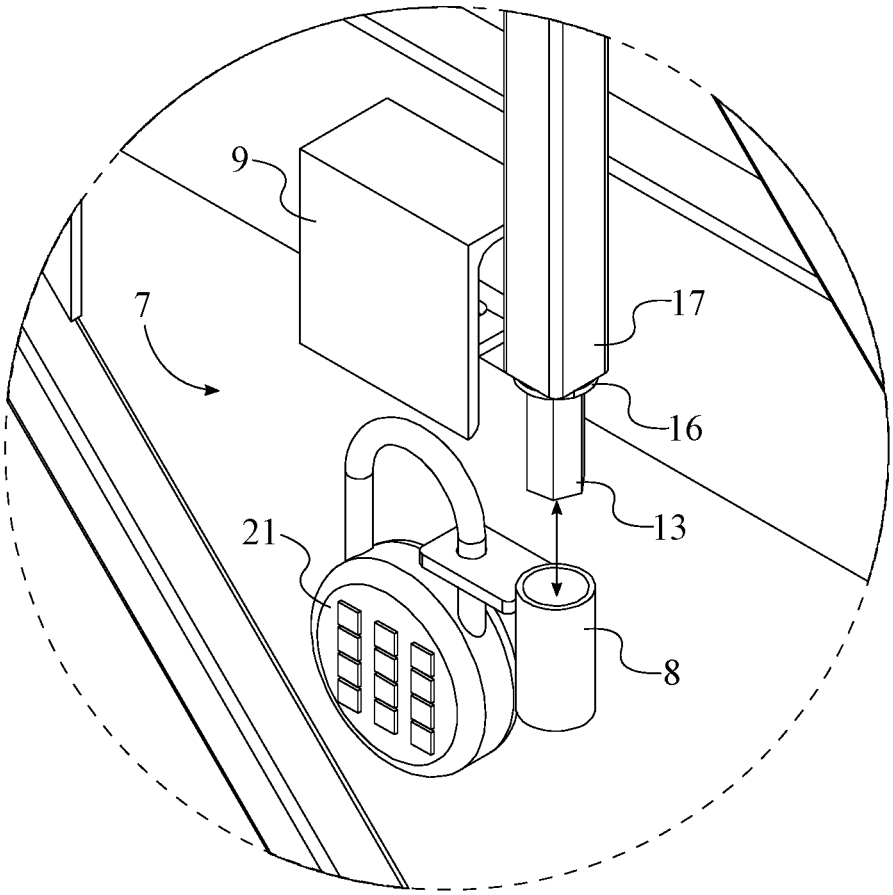
FIG. 6A is a detailed view taken about circle 6 in FIG. 5 in an exploded configuration.
Figure 6B:
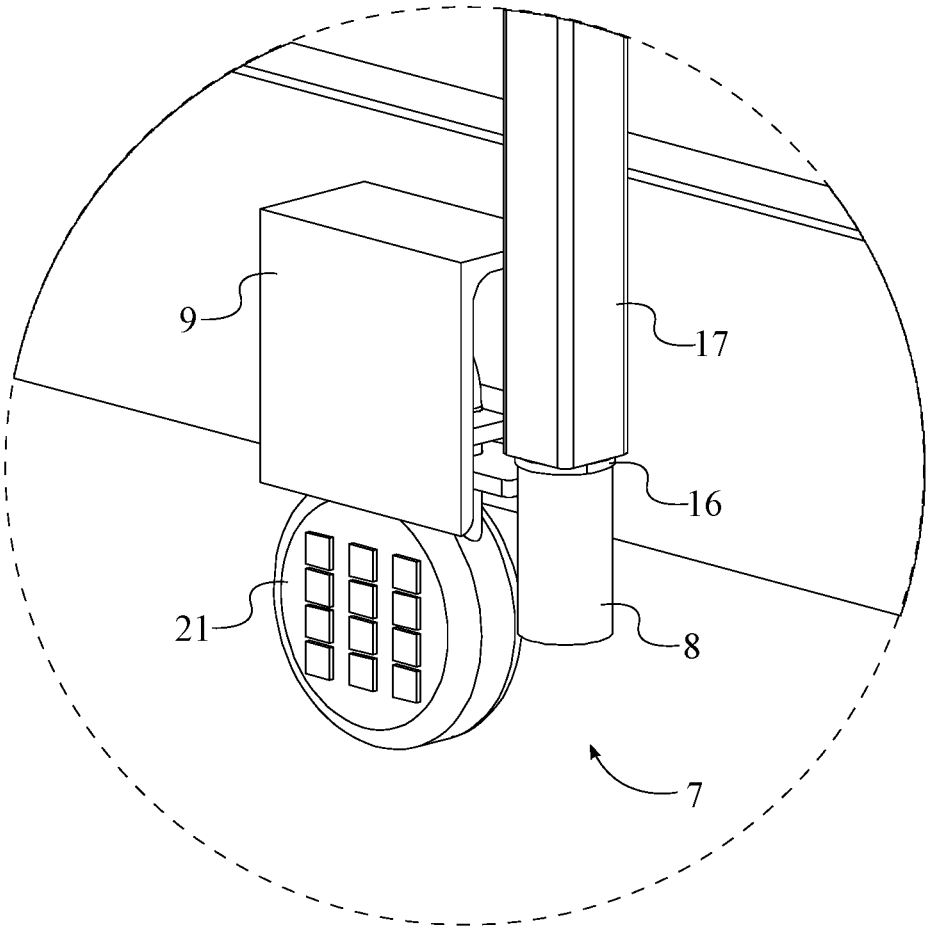
FIG. 6B is a detailed view taken about circle 6 in FIG. 5 in an operative configuration.

With reference to FIGS. 5, 6A, and 6B, the locking mechanism 7 comprises a rotational restraint 8 and a cover 9. The rotational restraint 8 is externally mounted to the turn knob 13. This arrangement allows the rotational restraint 8 to prevent the turn knob 13 from being rotated. In more detail, the rotational restraint 8 prevents the present invention from disengaging from a container. The cover 9 is mounted between the rotational restraint 8 and the elongated support structure 3. This arrangement prevents an unwanted user from removing the rotational restraint 8 from the present invention. In more detail, the cover 9 further prevents the present invention from being disengaged from a container.

With reference to FIGS. 1 and 3, the present invention may further comprise a restraining bracket 19. The restraining bracket 19 is used to restrain items that are positioned within the container that are not being restrained by the elongated support structure 3. The restraining bracket 19 is connected along the height-adjustment assembly 10. This arrangement allows the restraining bracket 19 to effectively restrain items even if the present invention is adjusted by the height-adjustment assembly 10.

Figure 7:
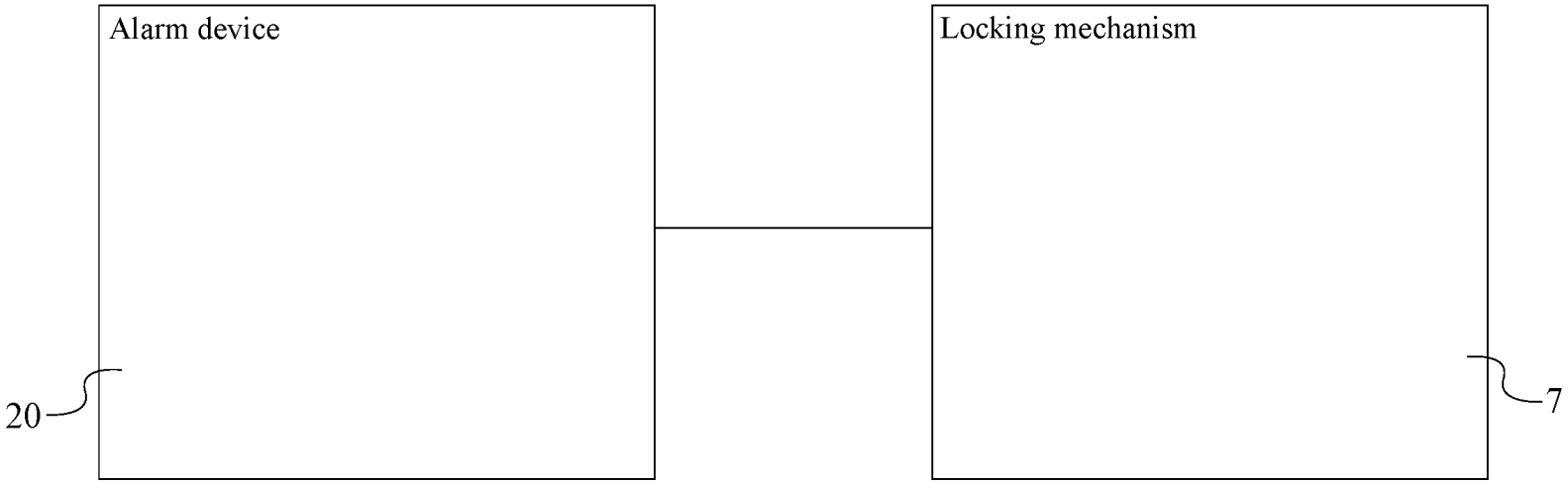
FIG. 7 is a schematic diagram of the electronic connections of the present invention.

With reference to FIG. 7, the present invention may further comprise an alarm device 20. The alarm device 20 is used to alert the user when an unwanted is attempting to breach the locking mechanism 7. The alarm device 20 can be any type of alarm device 20 such as, but not limited to, a sound alarm or light alarm. The alarm device 20 is mounted adjacent to the elongated support structure 3 and electronically connected to the locking mechanism 7. This arrangement properly positions the alarm device 20 so that the alarm device 20 can be electronically connected to the locking mechanism 7. The electronic connection between the alarm device 20 and the locking mechanism 7 allows the alarm device 20 to initiate when there is an attempt to breach the locking mechanism 7.

With reference to FIGS. 6A and 6B, the present invention may further comprise a lock interface 21. The lock interface 21 may be any type of lock assembly such as, but not limited to, a keypad, code entry lock, or a key entry lock. The lock interface 21 is mounted adjacent to the elongated support structure 3. The lock interface 21 is operatively coupled to the locking mechanism 7, wherein the lock interface 21 is used to engage and disengage the locking mechanism 7. This arrangement provides a security measure for the locking mechanism 7 that prevents an unwanted user from access the items positioned within a container.

With reference to FIG. 1, the present invention may further comprise a plurality of upper fastening features 22. The plurality of upper fastening features 22 is used to fully secure the upper bracket 1 to the inner top area of a container. The plurality of upper fastening features 22 is preferably a set of protrusions that are designed to fit within the lip of the inner top area of a container. The plurality of upper fastening features 22 is integrated into the upper bracket 1 and distributed along the upper bracket 1. This arrangement properly positions the upper fastening features in order for the upper bracket 1 to be fully secured to the inner top area of a container. Similarly, the present invention may further comprise a plurality of lower fastening features 23. The plurality of lower fastening features 23 is used to fully secure the lower bracket 2 to the inner bottom area of a container. The plurality of lower fastening features 23 is preferably a set of protrusions that are designed to fit within the lip of the inner bottom area of a container. The plurality of lower fastening features 23 is integrated into the lower bracket 2 and distributed along the lower bracket 2. This arrangement properly positions the plurality of lower fastening features 23 in order the lower bracket 2 to be fully secured to the inner bottom area of a container.

Although the invention has been explained in relation to its preferred embodiment, it is to be understood that many other possible modifications and variations can be made without departing from the spirit and scope of the invention as hereinafter claimed.

What is claimed is:

1. A bar security system comprises:
an upper bracket;
a lower bracket;
an elongated support structure;
a locking mechanism;
a height-adjustment assembly;
the upper bracket being terminally mounted to the elongated support structure;
the lower bracket being terminally mounted to the elongated support structure, opposite the upper bracket;
the locking mechanism being operatively integrated into the elongated support structure, wherein the locking mechanism is used to maintain an offset distance between the upper bracket and the lower bracket along the elongated support structure; and
the upper bracket being operatively coupled to the elongated support structure by the height-adjustment assembly, wherein the height-adjustment assembly is used to adjust the offset distance between the upper bracket and the lower bracket along the elongated support structure.

2. The bar security system as claimed in claim 1 comprises:
the elongated support structure comprises a first support, a second support, and at least one truss;
the first support and the second support being positioned parallel and offset from each other;
the at least one truss being connected in between the first support and the second support; and
the height-adjustment assembly being positioned in between the first support and the second support.

3. The bar security system as claimed in claim 2 comprises:
the height-adjustment assembly comprises a first tube and a second tube;
the first tube being terminally and perpendicularly connected to the upper bracket;
the second tube being terminally and perpendicularly connected to the upper bracket, opposite the first tube;
the first tube and the first support being telescopically engaged to each other; and
the second tube and the second support being telescopically engaged to each other.

4. The bar security system as claimed in claim 1 comprises:
the height-adjustment assembly comprises a turn knob, a male-threaded shaft, a female-threaded nut, and stopper;
the male-threaded shaft being positioned parallel to a first support and a second support;
the male-threaded shaft being rotatably connected to the elongated support structure;
the female-threaded nut being integrated into the upper bracket;
the turn knob being terminally and torsionally connected to the male-threaded shaft;
the stopper being laterally connected to the male-threaded shaft, adjacent to the turn knob; and
the male-threaded shaft being engaged into the female-threaded nut, opposite the turn knob.

5. The bar security system as claimed in claim 4 comprises:
the height-adjustment assembly further comprises a third tube and a fourth tube;
the third tube being centrally connected along the elongated support structure;
the male-threaded shaft being rotatably mounted within the third tube;
the fourth tube being centrally and perpendicularly connected along the upper bracket;
the female-threaded nut being terminally integrated into the fourth tube, opposite the upper bracket; and
the third tube and the fourth tube being telescopically engaged to each other.

6. The bar security system as claimed in claim 4 comprises:
the locking mechanism comprises a rotational restraint and a cover;
the rotational restraint being externally mounted to the turn knob; and
the cover being mounted between the rotational restraint and the elongated support structure.

7. The bar security system as claimed in claim 1 comprises:
a restraining bracket; and
the restraining bracket being connected along the height-adjustment assembly.

8. The bar security system as claimed in claim 1 comprises:
an alarm device;
the alarm device being mounted adjacent to the elongated support structure; and
the alarm device being electronically connected to the locking mechanism.

9. The bar security system as claimed in claim 1 comprises:
a lock interface;
the lock interface being mounted adjacent to the elongated support structure; and
the lock interface being operatively coupled to the locking mechanism, wherein the lock interface is used to engage and disengage the locking mechanism.

10. The bar security system as claimed in claim 1 comprises:
a plurality of upper fastening features;
the plurality of upper fastening features being integrated into the upper bracket; and
the plurality of upper fastening features being distributed along the upper bracket.

11. The bar security system as claimed in claim 1 comprises:
a plurality of lower fastening features;
the plurality of lower fastening features being integrated into the lower bracket; and
the plurality of lower fastening features being distributed along the lower bracket.

12. A bar security system comprises:
an upper bracket;
a lower bracket;
an elongated support structure;
a locking mechanism;
a height-adjustment assembly;
the height-adjustment assembly comprises a turn knob, a male-threaded shaft, a female-threaded nut, and stopper;
the upper bracket being terminally mounted to the elongated support structure;
the lower bracket being terminally mounted to the elongated support structure, opposite the upper bracket;
the locking mechanism being operatively integrated into the elongated support structure, wherein the locking mechanism is used to maintain an offset distance between the upper bracket and the lower bracket along the elongated support structure;
the upper bracket being operatively coupled to the elongated support structure by the height-adjustment assembly, wherein the height-adjustment assembly is used to adjust the offset distance between the upper bracket and the lower bracket along the elongated support structure;
the male-threaded shaft being positioned parallel to a first support and a second support;
the male-threaded shaft being rotatably connected to the elongated support structure;
the female-threaded nut being integrated into the upper bracket;
the turn knob being terminally and torsionally connected to the male-threaded shaft;
the stopper being laterally connected to the male-threaded shaft, adjacent to the turn knob; and
the male-threaded shaft being engaged into the female-threaded nut, opposite the turn knob.

13. The bar security system as claimed in claim 12 comprises:
the elongated support structure comprises a first support, a second support, and at least one truss;
the first support and the second support being positioned parallel and offset from each other;
the at least one truss being connected in between the first support and the second support; and
the height-adjustment assembly being positioned in between the first support and the second support.

14. The bar security system as claimed in claim 13 comprises:
the height-adjustment assembly further comprises a first tube and a second tube;
the first tube being terminally and perpendicularly connected to the upper bracket;
the second tube being terminally and perpendicularly connected to the upper bracket, opposite the first tube;
the first tube and the first support being telescopically engaged to each other; and
the second tube and the second support being telescopically engaged to each other.

15. The bar security system as claimed in claim 12 comprises:
the height-adjustment assembly further comprises a third tube and a fourth tube;
the third tube being centrally connected along the elongated support structure;
the male-threaded shaft being rotatably mounted within the third tube;
the fourth tube being centrally and perpendicularly connected along the upper bracket;
the female-threaded nut being terminally integrated into the fourth tube, opposite the upper bracket; and
the third tube and the fourth tube being telescopically engaged to each other.

16. The bar security system as claimed in claim 12 comprises:
the locking mechanism comprises a rotational restraint and a cover;
the rotational restraint being externally mounted to the turn knob; and
the cover being mounted between the rotational restraint and the elongated support structure.

17. The bar security system as claimed in claim 12 comprises:
a restraining bracket; and
the restraining bracket being connected along the height-adjustment assembly.

18. The bar security system as claimed in claim 12 comprises:
an alarm device;
the alarm device being mounted adjacent to the elongated support structure; and
the alarm device being electronically connected to the locking mechanism.

19. The bar security system as claimed in claim 12 comprises:
a lock interface;
the lock interface being mounted adjacent to the elongated support structure; and
the lock interface being operatively coupled to the locking mechanism, wherein the lock interface is used to engage and disengage the locking mechanism.

20. The bar security system as claimed in claim 12 comprises:
a plurality of upper fastening features;
a plurality of lower fastening features;
the plurality of upper fastening features being integrated into the upper bracket;
the plurality of upper fastening features being distributed along the upper bracket;
the plurality of lower fastening features being integrated into the lower bracket; and
the plurality of lower fastening features being distributed along the lower bracket.

* * * * *